US011033113B2

(12) United States Patent
Zeng et al.

(10) Patent No.: US 11,033,113 B2
(45) Date of Patent: Jun. 15, 2021

(54) INTEGRATED FOLDING BED

(71) Applicant: Guohong Zeng, Qingyuan (CN)

(72) Inventors: Guohong Zeng, Qingyuan (CN); Gary Thomas Kinion, Farmington, AR (US); Muriel Lynn Kelley, Farmington, AR (US); Singer Theodore Louis, Farmington, AR (US)

( * ) Notice: Subject to any disclaimer, the term of this patent is extended or adjusted under 35 U.S.C. 154(b) by 0 days.

(21) Appl. No.: 16/662,078

(22) Filed: Oct. 24, 2019

(65) Prior Publication Data

US 2020/0054148 A1 Feb. 20, 2020

(51) Int. Cl.
*A47C 19/12* (2006.01)
*A47C 20/04* (2006.01)

(52) U.S. Cl.
CPC ..... *A47C 19/126* (2013.01); *A47C 20/041* (2013.01)

(58) Field of Classification Search
CPC ..... A47C 19/00; A47C 19/04; A47C 19/12; A47C 19/126
See application file for complete search history.

(56) References Cited

U.S. PATENT DOCUMENTS 4,225,988 A * 10/1980 Cary ..... A61G 7/015 5/607
2009/0021142 A1* 1/2009 Park ..... H01J 63/06 313/503

* cited by examiner

*Primary Examiner* — Fredrick C Conley
(74) *Attorney, Agent, or Firm* — HYIP

(57) ABSTRACT

The present disclosure relates to the technical field of electric beds, and in particular to an integrated folding bed, which solves a technical problem that the width of a bed body is inconveniently adjusted in the prior art. The integrated folding bed comprises a bed body, bed feet and a bed frame, and the bed body is formed by multiple sequentially connected folding main bed boards, wherein an expanding bed board for widening the bed body is integrally arranged on one side face of the main bed board, the main bed board and the expanding bed board are connected through a hinge, two leaves of the hinge are respectively and fixedly mounted on an upper surface of the main bed board and an upper surface of the expanding bed board, and a pin of the hinge is arranged upwards.

11 Claims, 8 Drawing Sheets

INTEGRATED FOLDING BED

TECHNICAL FIELD

The present disclosure relates to the technical field of electric beds, and in particular to an integrated folding bed.

BACKGROUND

An electric bed has a bed frame, in which the height of the head or the foot of a bed board can be electrically controlled and the bending degree of the bed board can be freely adjusted, and can be classified into a slatted bed base type and a bed board type.

A bed body is generally folded in a transportation procedure in order to reduce transportation cost. However, the existing electric bed generally only can be folded in a length direction and is hardly folded in a width direction, especially a certain folding electric bed achieves folding and combining functions through detachable connection of a main bed body and expanding bed body such that the whole bed body is a separate type, and multiple expanding bed bodies need to be connected with the main bed body one by one in an assembling procedure and be stacked one by one in a folding procedure after the expanding bed bodies are detached from the main bed body so that the width of the bed body is inconveniently adjusted.

SUMMARY

An objective of the present disclosure is to provide an integrated folding bed, which solves a technical problem that the width of a bed body is inconveniently adjusted in the prior art.

To achieve the above objective, the present disclosure adopts the following technical solution:

The integrated folding bed comprises a bed body, bed feet and a bed frame, and the bed body is formed by multiple sequentially connected folding main bed boards, wherein an expanding bed board for widening the bed body is integrally arranged on one side face of the main bed board, the main bed board and the expanding bed board are connected through a hinge, two leaves of the hinge are respectively and fixedly mounted on an upper surface of the main bed board and an upper surface of the expanding bed board, and a pin of the hinge is arranged upwards.

Preferably, the bed foot comprises a cylindrical fixing part, a first inserting part, a second inserting part and embedding parts, one end of the fixing part is mounted on a lower surface of the bed frame, and the fixing part and the first inserting part are connected through one embedding part while the first inserting part and the second inserting part are connected through the other embedding part.

Preferably, one end of the two embedding parts is respectively mounted on the first inserting part and the second inserting part, and the embedding part located on the first inserting part is inserted into the second inserting part while the embedding part located on the second inserting part is inserted into the fixing part.

Preferably, L-shaped limiting grooves are opened in the embedding parts, limiting blocks penetrate horizontal sections of the limiting grooves and can move in the limiting grooves, and one end of one limiting block is fixedly mounted on an inner wall of the fixing part while one end of the other limiting block is fixedly mounted on an inner wall of the second inserting part.

Preferably, clamping grooves are opened in surfaces of the limiting blocks and match with the thickness of the embedding parts, and edge portions of the limiting grooves are inserted into the clamping grooves.

Preferably, inclined guide surfaces are arranged on two sides of an opening of each limiting groove.

Preferably, the fixing part and the first inserting part have the same outer diameter, and an outer diameter difference between the embedding part and the first inserting part is equal to the thickness of the fixing part.

Compared with the prior art, beneficial effects of the present disclosure lie in:

due to arrangement of a folding connection state between the expanding bed board and the main bed board, the size of the bed body can be reduced to reduce transportation cost, especially the expanding bed board and the main bed board are connected through the hinge so that an integrated structure of the bed body is maintained while a folding function is achieved; compared with the prior art that the expanding bed body is detached and separated from the main bed body, the present disclosure has the advantages: when the bed body is folded, movement trajectories of the expanding bed bodies in a folding procedure and positions of the folded expanding bed bodies are constant and not mutually interfered, so that the folding of the bed body is more convenient, and the folded bed body can be in an orderly state; similarly, in an unfolding procedure, compared with the prior art that the expanding bed body and the main bed body are separated and reassembled, the present disclosure has the advantages: the main bed body and the expanding bed body are always integrated after being folded, so in an unfolding procedure, the expanding bed bodies do not need to be connected with the main bed body one by one, convenience is improved, and a standard bed body structure can be shown after the bed body is unfolded.

BRIEF DESCRIPTION OF THE DRAWINGS

To describe the technical solutions in the embodiments of the present disclosure more clearly, the following briefly introduces the accompanying drawings for describing the embodiments. Apparently, the accompanying drawings in the following description show merely some embodiments of the present disclosure, and a person of ordinary skill in the art may still derive other drawings from these accompanying drawings without creative efforts.

Figure 1:
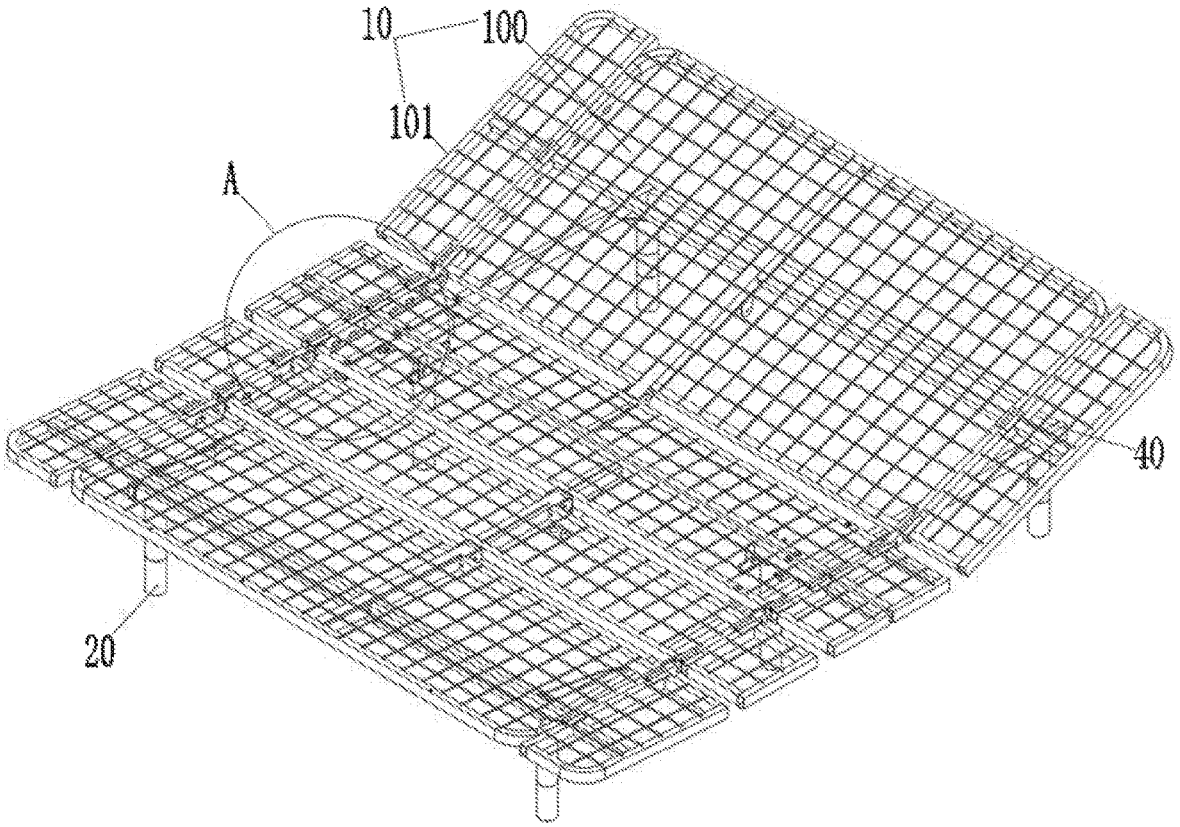
FIG. 1 is a schematic structural diagram of the present disclosure.

In the drawings: 10—bed body, 100—main bed board, 101—expanding bed board, 20—bed foot, 201—fixing part, 202—first inserting part, 203—embedding part, 204—limiting groove, 205—limiting block, 206—clamping groove,

207—guide surface, 208—second inserting part, 30—hinge, 301—leaf, 302—pin, and 40—bed frame.

DESCRIPTION OF THE EMBODIMENTS

To make the objectives, technical solutions, and advantages of the present disclosure clearer, the following further describes the present disclosure in detail with reference to the accompanying drawings and embodiments. Understandably, the described specific embodiments are merely used to explain the present disclosure, rather than to limit the present disclosure.

Figure 2:
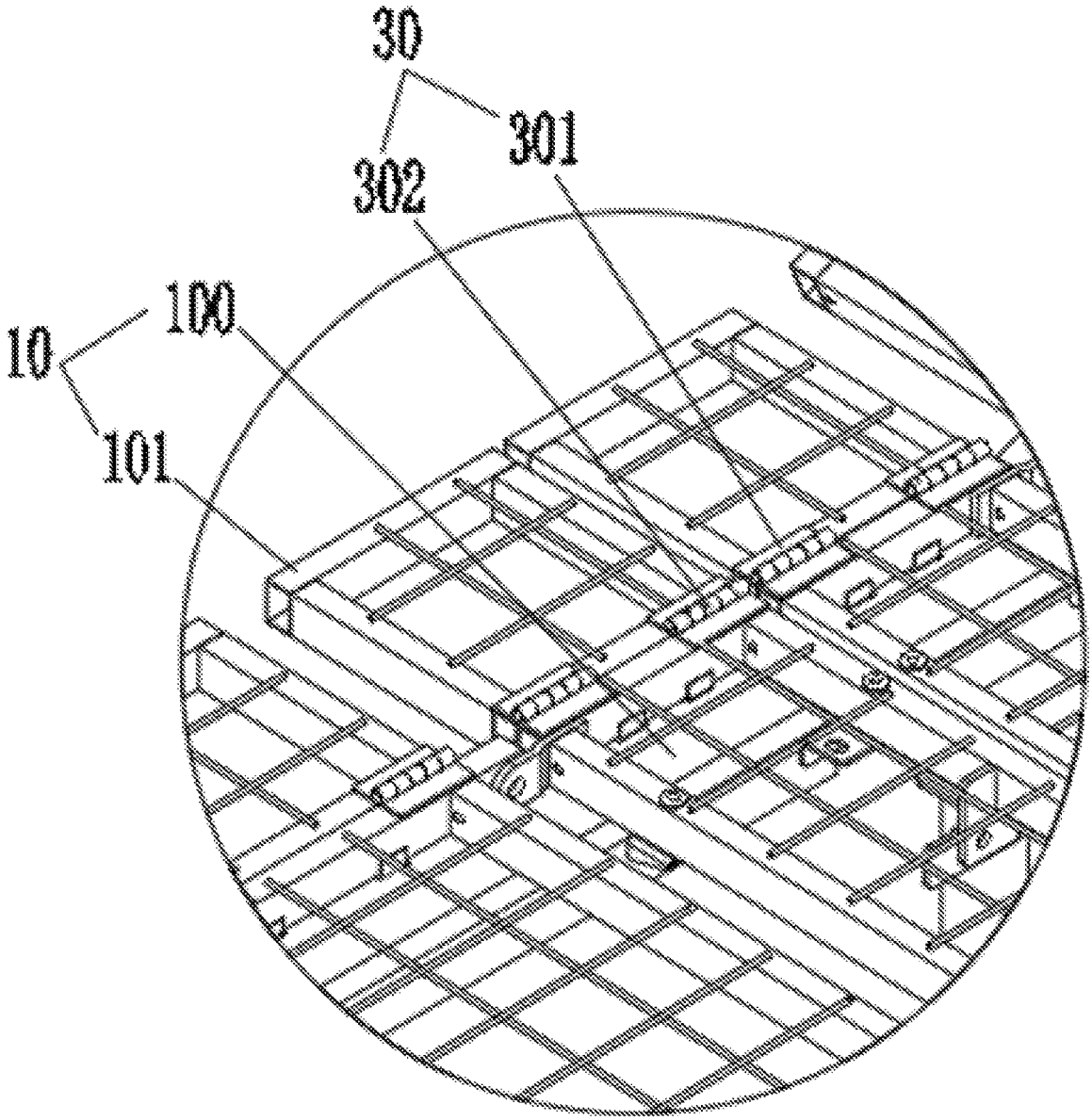
FIG. 2 is an enlarged view of a part A in FIG. 1.
Figure 3:
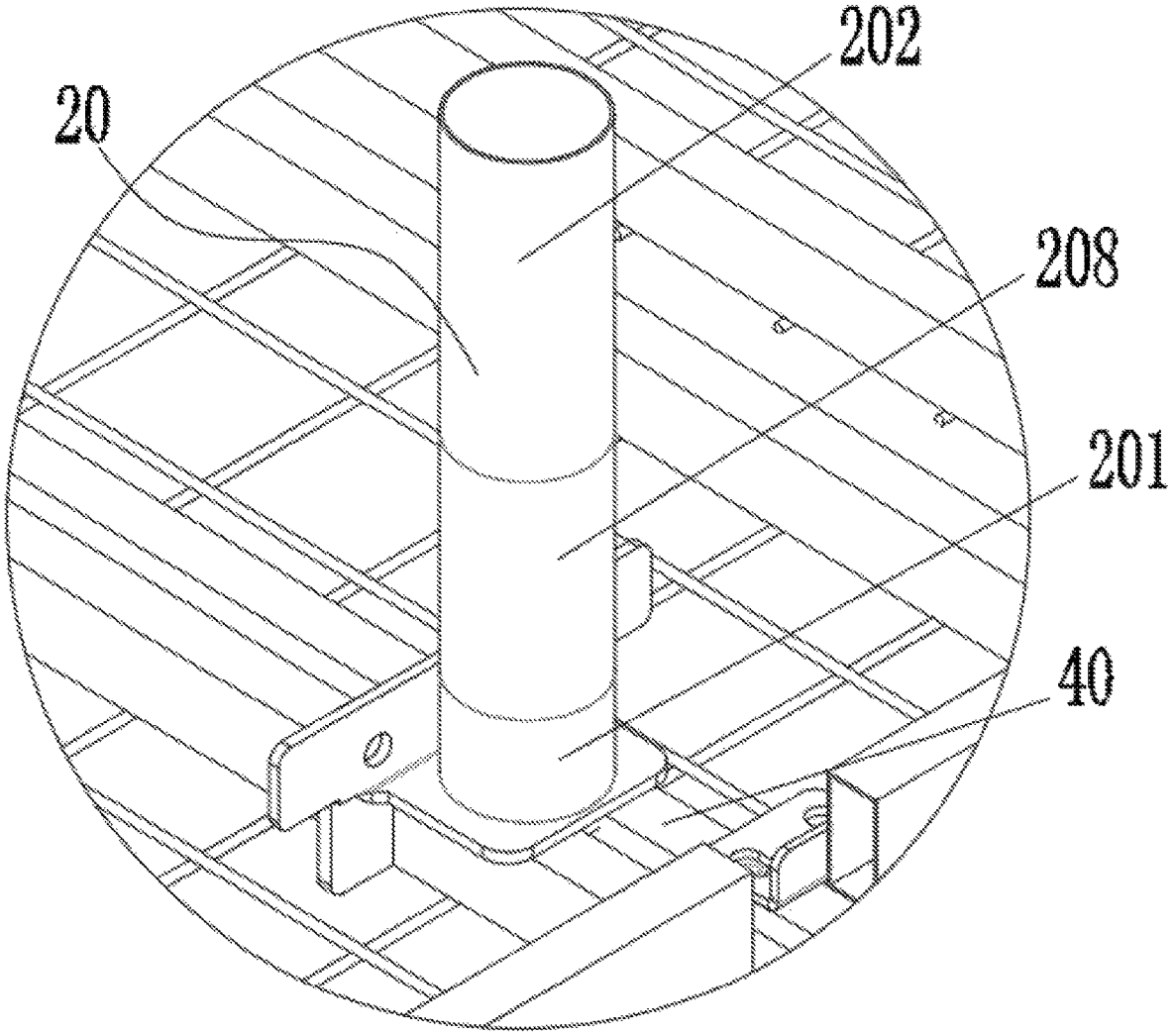
FIG. 3 is a schematic diagram showing connection of a bed foot and a bed frame of the present disclosure.
Figure 4:
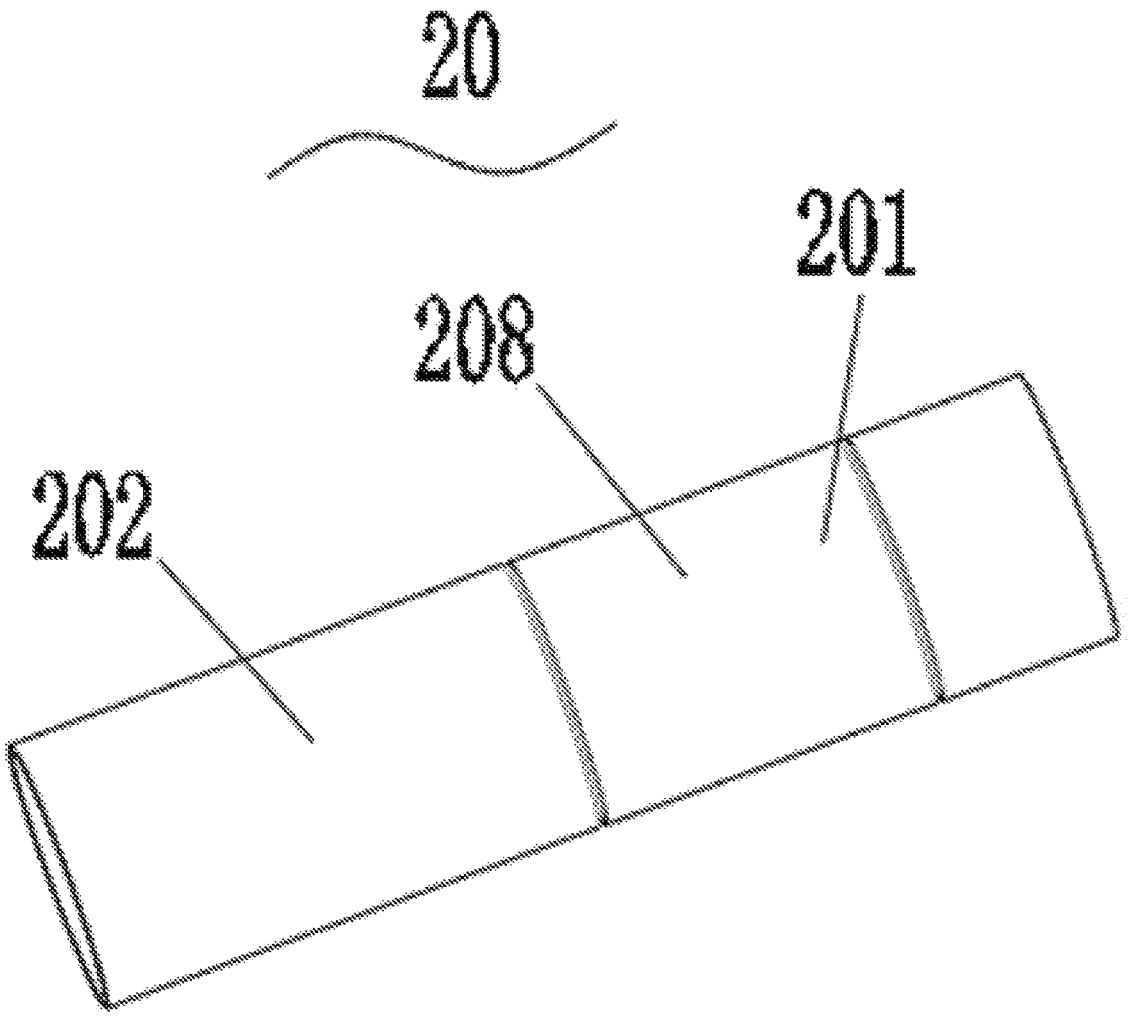
FIG. 4 is a schematic diagram of a bed foot of the present disclosure.

Referring to FIG. 1 and FIG. 2, an integrated folding bed comprises a bed body 10, bed feet 20 and a bed frame 40, and the bed body 10 is formed by multiple sequentially connected folding main bed boards 100, specifically, two sides between the main bed boards 100 are rotationally connected through rotary shafts to achieve folding and unfolding of two adjacent main bed boards 100; an expanding bed board 101 for widening the bed body is integrally arranged on one side face of the main bed board 100, and the function of the expanding bed board 101 is: in use, the expanding bed board 101 can increase the size of the main bed board 100 so as to increase the size the whole bed body 10, and the expanding bed board 101 is folded on the main bed board 100 in a transporting procedure to reduce the transportation size of the bed body 10 and then to reduce the transportation cost; referring to FIG. 1 and FIG. 2, the main bed board 100 and the expanding bed board 101 are connected through a hinge 30, two leaves 301 of the hinge 30 are respectively and fixedly mounted on an upper surface of the main bed board 100 and an upper surface of the expanding bed board 101, and a pin 302 of the hinge 30 is arranged upwards; due to such arrangement, the main bed board 100 and the expanding bed board 101 can not only be folded and unfolded through the hinge 30, and in an unfolding state, the pin 302 of the hinge 30 is arranged upwards so that the main bed board 100 and the expanding bed board 101 can be in contact so as to improve stability of the main bed board 100 and the expanding bed board 101.

The embodiment has the following working procedure:

the main bed board 100 and the expanding bed board 101 rotate to be unfolded by taking the hinge 30 as an axis, or the main bed board 100 and the expanding bed board 101 rotate to be folded by taking the hinge 30 as the axis so as to achieve the folding and the unfolding of the whole bed body 10, and then in the transportation procedure, the size of the bed body 10 can be reduced in a folding manner so as to reduce the transportation cost; especially the expanding bed board 101 and the main bed board 100 are connected through the hinge 30 such that the integrated structure of the bed body 10 is still maintained while the folding function is achieved; compared with the prior art that an expanding bed body 10 is directly detached and separated from the main bed board 10, the present disclosure has the advantages: when the bed body 10 is folded, movement trajectories of the expanding bed bodies 10 in a folding procedure and positions of the folded expanding bed bodies are constant and not mutually interfered, so that the folding of the bed body 10 is more convenient, and the folded bed body can be in an orderly state; similarly, in an unfolding procedure, compared with the prior art that the expanding bed body 10 and the main bed body 10 are separated and reassembled, the present disclosure has the advantages: the main bed body 10 and the expanding bed body 10 are always integrated after being folded, so in the unfolding procedure, the expanding bed bodies 10 do not need to be connected with the main bed body 10 one by one, convenience is improved, and a standard bed body 10 structure can be shown after the bed body 10 is unfolded.

Referring to FIG. 1 to FIG. 6, in the embodiment, the bed foot 20 comprises a cylindrical fixing part 201, a first inserting part 202, a second inserting part 208 and embedding parts 203, one end of the fixing part 201 can be connected with the bed frame 40 in a welding manner, the fixing part 201 and the first inserting part 202 are connected through one embedding part 203 while the first inserting part 202 and the second inserting part 208 are connected through the other embedding part 203, one end of the two embedding parts 203 is respectively mounted on the first inserting part 202 and the second inserting part 208, and the embedding part 203 located on the first inserting part 202 is inserted into the second inserting part 208 while the embedding part 203 located on the second inserting part 208 is inserted into the fixing part 201; by respectively inserting the two embedding parts 203 into the fixing part 201 and the second inserting part 208, the first inserting part 202 and the second inserting part 208 can be connected while the second inserting part 208 and the fixing part 201 can be connected so as to achieve assembly of the bed foot 20; the embedding part 203 is pulled out of the second inserting part 208 by pulling the first inserting part 202, and the embedding part 203 is pulled out of the fixing part 201 by pulling the second inserting part 208 so that the bed foot 20 can be detached; and due to such arrangement, the bed foot 20 is detachable, after the bed foot 20 is detached in a bed body 10 folding procedure, the size of the bed foot 20 is reduced so as to further reduce the size of the folded bed body 10, which is more convenient to transport.

Figure 5:
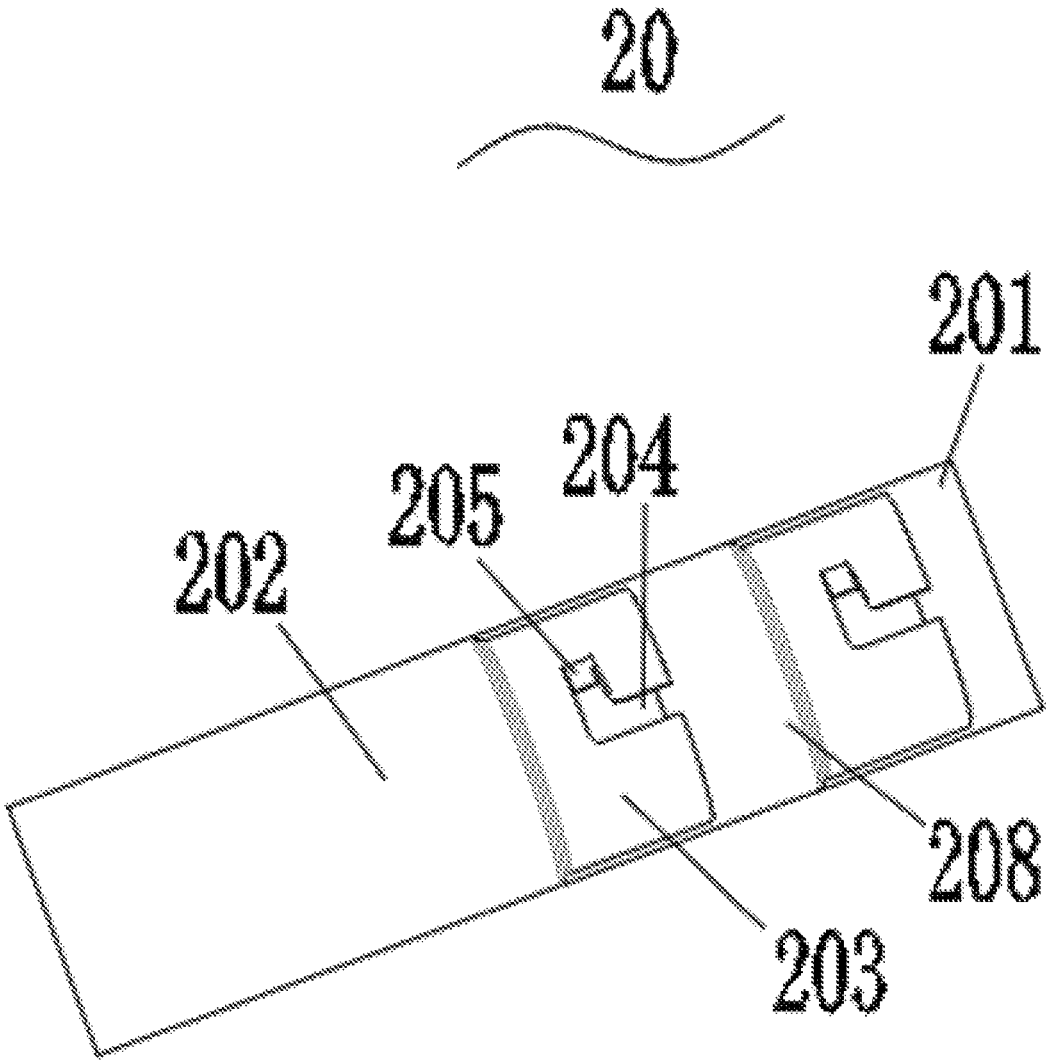
FIG. 5 is a sectional view of a bed foot of the present disclosure.
Figure 6:
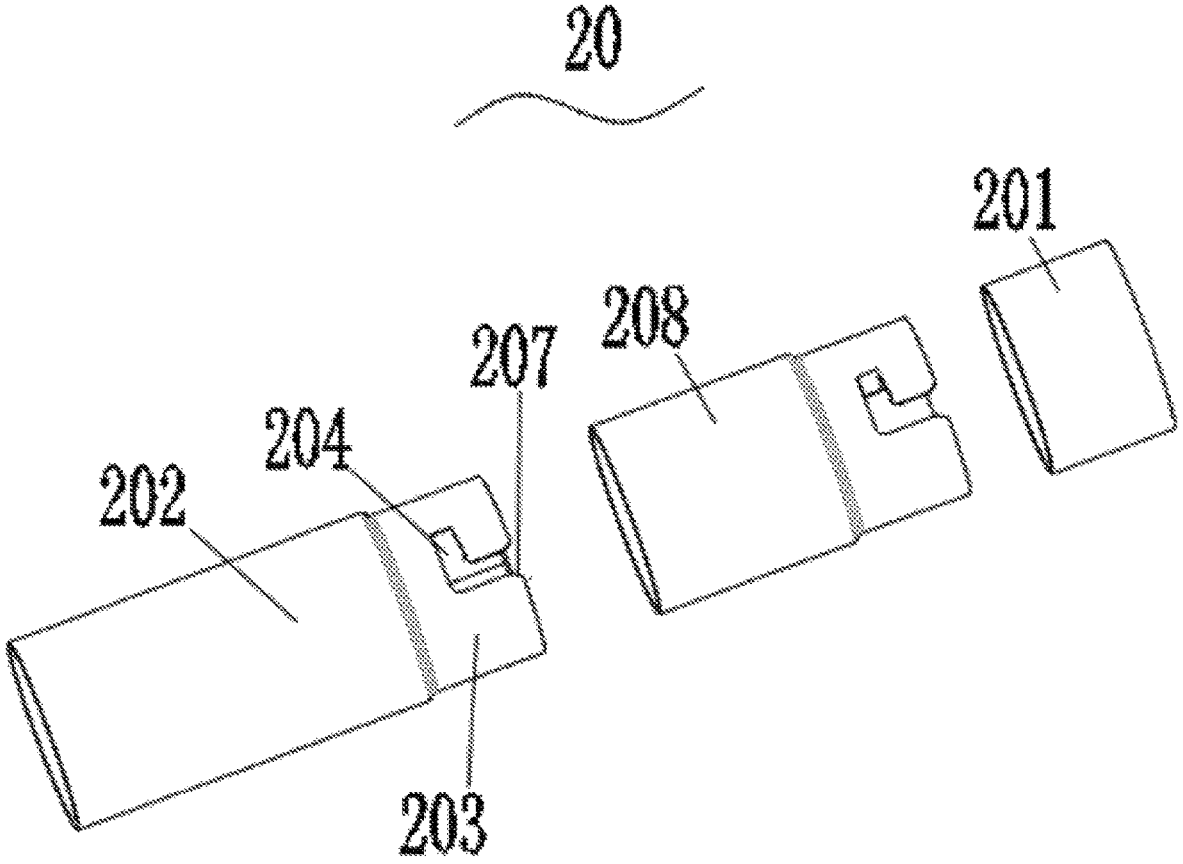
FIG. 6 is an exploded view of a bed foot of the present disclosure.
Figure 7:
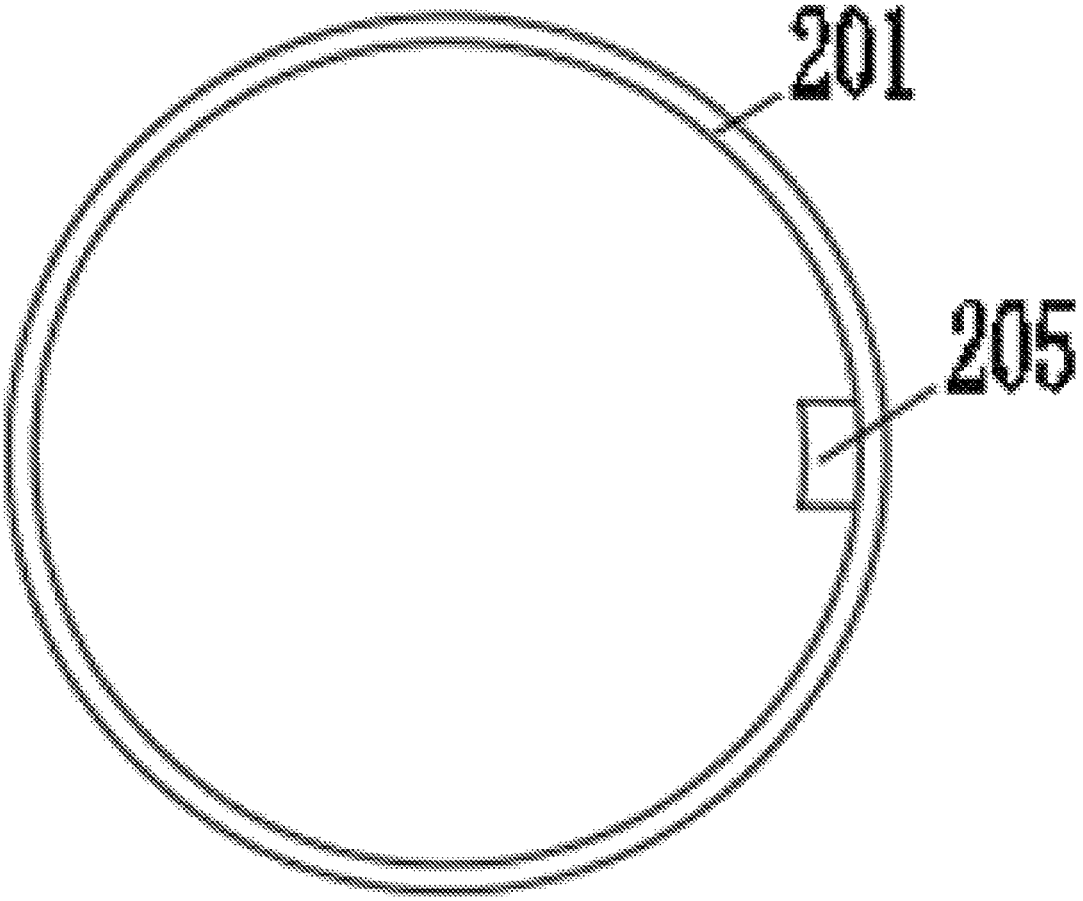
FIG. 7 is a schematic diagram showing connection of a limiting block and a fixing part of the present disclosure.

Referring to FIG. 5, FIG. 6 and FIG. 7, L-shaped limiting grooves 204 are opened in the embedding parts 203, limiting blocks 205 penetrate horizontal sections of the limiting grooves 204 and can move in the limiting grooves 204, and one end of one limiting block 205 is fixedly mounted on an inner wall of the fixing part 201 while one end of the other limiting block 205 is fixedly mounted on an inner wall of the second inserting part 208. When the embedding part 203 of the second inserting part 208 is inserted into the fixing part 201, the opening of the corresponding limiting groove 204 is aligned to the corresponding limiting block 205 and then is inserted; when the embedding part 203 cannot be continuously inserted, the second inserting part 208 is rotated, the embedding part 203 rotates along with the rotating of the second inserting part 208 and drives the limiting groove 204 to rotate, and at this time, the limiting block 205 moves in the limiting groove 204; when the second inserting part 208 cannot be continuously rotated, the limiting block 205 moves to a furthest end of the horizontal section of the limiting groove 204, and at this time, the limiting block 205 and the limiting groove 204 effectively fix the fixing part 201 and the second inserting part 208 in a length direction of the bed foot 20; and similarly, the first inserting part 201 and the second inserting part 208 are connected and fixed to be capable of improving stability of the bed foot 20.

Figure 8:
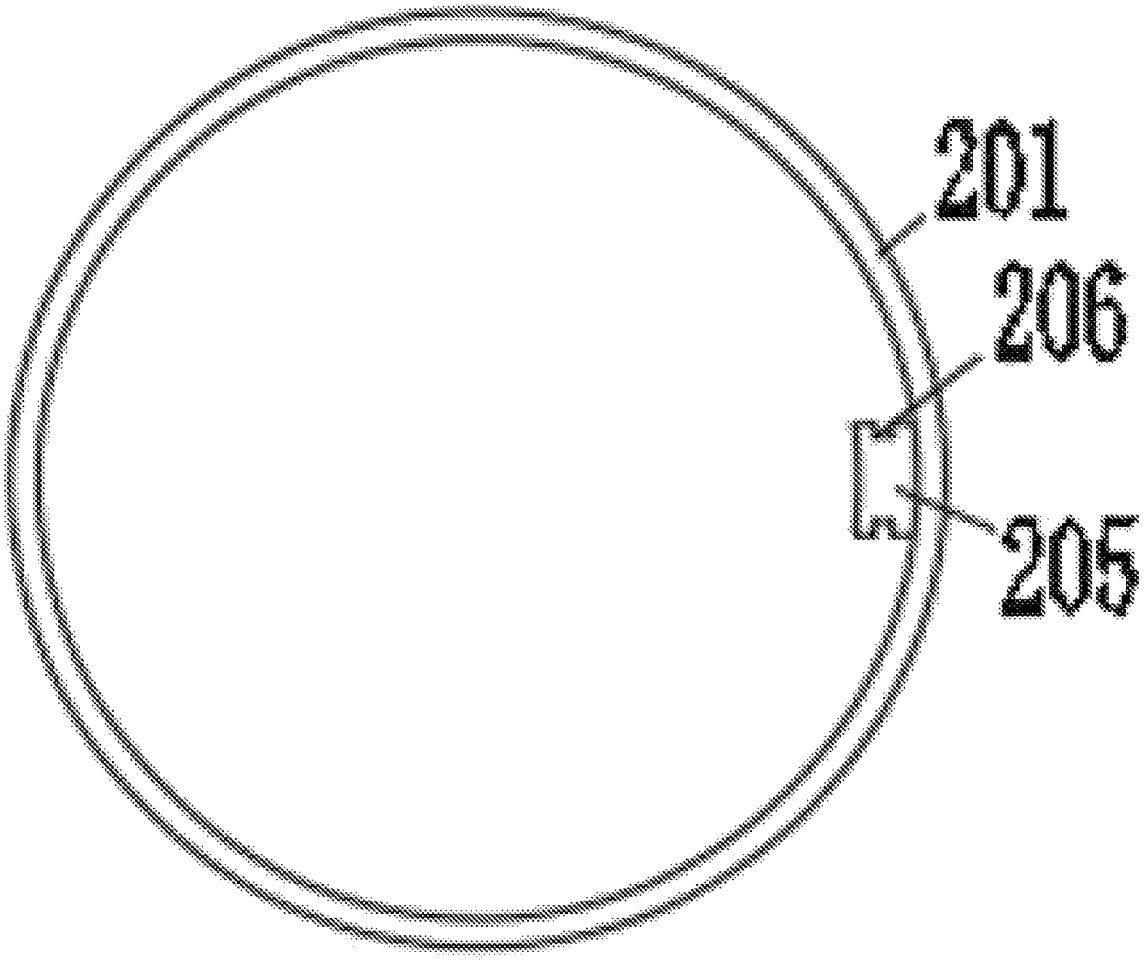
FIG. 8 is a schematic diagram of a clamping groove of the present disclosure.

Referring to FIG. 8, clamping grooves 206 are opened in surfaces of the limiting blocks 205 and match with the thickness of the embedding parts 203, and edge portions of the limiting grooves 204 are inserted into the clamping grooves 206; therefore, when the limiting blocks 205 enter the limiting grooves 204, portions, located at edges of the limiting grooves 204, of the embedding parts 203 of the limiting grooves 204 are also inserted into the clamping grooves 206 such that the limiting blocks 205 can further radially fix the fixing part 201 and the second inserting part 208, and the first inserting part 202 and the second inserting part 208 while matching with the embedding parts 203 so as to improve the stability of the bed foot 20.

Referring to FIG. 6, inclined guide surfaces 207 are arranged on two sides of an opening of each limiting groove 204. Due to such arrangement, when the limiting blocks 205 enters the limiting grooves 204 through the openings of the limiting grooves 204, the two limiting blocks 205 are respectively located in the fixing part 201 and the second inserting part 208 and cannot be directly seen, so the inclination state of the guide surfaces 207 is more beneficial to help the limiting blocks 205 to enter the guide grooves 204, thereby improving convenience of folding and unfolding operations of the bed body 10.

In the embodiment, the fixing part 201, the first inserting part 202 and the second inserting part 208 have the same outer diameter, and an outer diameter difference between the embedding part 203 and the first inserting part 202 is equal to the thickness of the fixing part 201. Due to such arrangement, after the bed foot 20 is assembled, the appearance of the bed foot 20 is smooth and beautiful; secondly, surfaces of the two embedding parts 203 are respectively in contact with an inner wall of the second inserting part 208 and an inner wall of the fixing part 201 such that the whole stability of the bed foot 20 is better; furthermore, during machining, the second inserting part 208, the fixing part 201 and the first inserting part 202 have the same outer diameter so as to facilitate production and processing to a certain extent.

In conclusion, the integrated folding bed of the present disclosure reduces the transportation cost in a folding manner, and the folding and unfolding of the bed body 10 are convenient such that the integrated folding bed has high practicability and wide market popularizing prospect.

The foregoing displays and describes the basic principles, the main features and the advantages of the present disclosure. Persons skilled in the art should know that the present disclosure is not limited by the above embodiments. The above embodiments and the specification merely describe the principle of the present disclosure. The present disclosure further has various changes and improvements without departing from the principle of the present disclosure, and these changes and improvements should fall in the protection scope of the present disclosure. The protection scope of the present disclosure is limited by the appended claims and their legal equivalents.

What is claimed is:

1. An integrated folding bed, comprising a bed body (10), bed feet (20) and a bed frame (40), wherein the bed body (10) is formed by multiple sequentially connected folding main bed boards (100); and an expanding bed board (101) for widening the bed body is integrally arranged on one side face of the main bed board (100), the main bed board (100) and the expanding bed board (101) are connected through a hinge (30), two leaves (301) of the hinge (30) are respectively and fixedly mounted on an upper surface of the main bed board (100) and an upper surface of the expanding bed board (101), and a pin (302) of the hinge (30) is arranged upwards; the bed foot (20) comprises a cylindrical fixing part (201), a first inserting part (202), a second inserting part (208) and embedding parts (203), one end of the fixing part (201) is mounted on a lower surface of the bed frame (40), and the fixing part (201) and the first inserting part (202) are connected through one embedding part (203) while the first inserting part (202) and the second inserting part (208) are connected through the other embedding part (203).

2. The integrated folding bed according to claim 1, wherein one end of the two embedding parts (203) is respectively mounted on the first inserting part (202) and the second inserting part (208), and the embedding part (203) located on the first inserting part (202) is inserted into the second inserting part (208) while the embedding part (203) located on the second inserting part (208) is inserted into the fixing part (201).

3. The integrated folding bed according to claim 2, wherein the fixing part (201), the first inserting part (202) and the second inserting part (208) have the same outer diameter, and an outer diameter difference between the embedding part (203) and the first inserting part (202) is equal to the thickness of the fixing part (201).

4. The integrated folding bed according to claim 2, wherein L-shaped limiting grooves (204) are opened in the embedding parts (203), limiting blocks (205) penetrate horizontal sections of the limiting grooves (204) and can move in the limiting grooves (204), and one end of one limiting block (205) is fixedly mounted on an inner wall of the fixing part (201) while one end of the other limiting block (205) is fixedly mounted on an inner wall of the second inserting part (208).

5. The integrated folding bed according to claim 4, wherein clamping grooves (206) are opened in surfaces of the limiting blocks (205) and match with the thickness of the embedding parts (203), and edge portions of the limiting grooves (204) are inserted into the clamping grooves (206).

6. The integrated folding bed according to claim 5, wherein the fixing part (201), the first inserting part (202) and the second inserting part (208) have the same outer diameter, and an outer diameter difference between the embedding part (203) and the first inserting part (202) is equal to the thickness of the fixing part (201).

7. The integrated folding bed according to claim 4, wherein inclined guide surfaces (207) are arranged on two sides of an opening of each limiting groove (204).

8. The integrated folding bed according to claim 7, wherein the fixing part (201), the first inserting part (202) and the second inserting part (208) have the same outer diameter, and an outer diameter difference between the embedding part (203) and the first inserting part (202) is equal to the thickness of the fixing part (201).

9. The integrated folding bed according to claim 4, wherein the fixing part (201), the first inserting part (202) and the second inserting part (208) have the same outer diameter, and an outer diameter difference between the embedding part (203) and the first inserting part (202) is equal to the thickness of the fixing part (201).

10. The integrated folding bed according to claim 1, wherein the fixing part (201), the first inserting part (202) and the second inserting part (208) have the same outer diameter, and an outer diameter difference between the embedding part (203) and the first inserting part (202) is equal to the thickness of the fixing part (201).

11. The integrated folding bed according to claim 1, wherein the fixing part (201), the first inserting part (202) and the second inserting part (208) have the same outer diameter, and an outer diameter difference between the embedding part (203) and the first inserting part (202) is equal to the thickness of the fixing part (201).

* * * * *